US007314114B2

(12) United States Patent
Gardner et al.

(10) Patent No.: US 7,314,114 B2
(45) Date of Patent: Jan. 1, 2008

(54) FLAT PANEL DIFFUSER

(75) Inventors: John Wesley Gardner, Newburg, MD (US); Clarence Nicholas Colleran, Jr., Richmond, VA (US)

(73) Assignee: Acoustics First Corporation, Richmond, VA (US)

( * ) Notice: Subject to any disclaimer, the term of this patent is extended or adjusted under 35 U.S.C. 154(b) by 395 days.

(21) Appl. No.: 10/775,192

(22) Filed: Feb. 11, 2004

(65) Prior Publication Data

US 2005/0173187 A1 Aug. 11, 2005

(51) Int. Cl.
*E04B 1/82* (2006.01)

(52) U.S. Cl. ..... 181/293; 181/284; 181/286; 181/288; 181/290

(58) Field of Classification Search ..... 181/284, 181/286, 288, 290, 291, 292, 293; 333/193, 333/194, 195, 196
See application file for complete search history.

(56) References Cited

U.S. PATENT DOCUMENTS

| | | | | |
|---|---|---|---|---|
| 2,887,173 | A | | 5/1959 | Boschi |
| 2,913,075 | A | | 11/1959 | Zittle |
| 2,989,136 | A | | 6/1961 | Wohlberg |
| 3,276,537 | A | | 10/1966 | Halbosted et al. |
| 3,621,934 | A | | 11/1971 | Thrasher et al. |
| 4,001,473 | A | | 1/1977 | Cook |
| 4,071,989 | A | | 2/1978 | Warren |
| 4,084,367 | A | | 4/1978 | Saylor et al. |
| 4,244,439 | A | | 1/1981 | Wested |
| 4,257,998 | A | | 3/1981 | Diepenbrock, Jr. et al. |
| 4,279,325 | A | | 7/1981 | Challis |
| 4,303,144 | A | | 12/1981 | Wirt |
| 4,496,024 | A | * | 1/1985 | Wolf et al. ..... 181/292 |
| 4,522,284 | A | | 6/1985 | Fearon et al. |
| 4,529,637 | A | | 7/1985 | Hankel |
| 4,621,709 | A | | 11/1986 | Naslund |
| 4,815,018 | A | * | 3/1989 | Reinhardt et al. ..... 708/101 |
| 4,821,839 | A | | 4/1989 | D'Antonio et al. |
| 4,821,841 | A | | 4/1989 | Woodward et al. |
| 5,160,816 | A | | 11/1992 | Chlop |
| 5,298,694 | A | | 3/1994 | Thompson et al. |
| 5,401,921 | A | | 3/1995 | D'Antonio et al. |
| 5,459,291 | A | | 10/1995 | Haines et al. |

(Continued)

*Primary Examiner*—Lincoln Donovan
*Assistant Examiner*—Jeremy Luks
(74) *Attorney, Agent, or Firm*—Oblon, Spivak, McClelland, Maier & Neustadt, P.C.

(57) ABSTRACT

A device including a membrane having first and second faces; a first substrate disposed on the first face of the membrane and having (i) a plurality of first absorptive regions and (ii) a plurality of first reflective regions formed as wells in a face of the first substrate, the first absorptive regions and the first reflective regions arranged in a pre-defined grid pattern; a second substrate disposed on the second face of the membrane and having (i) a plurality of second absorptive regions and (ii) a plurality of second reflective regions formed as second wells in a face of the second substrate, the second absorptive regions and the second reflective regions arranged in the pre-defined grid pattern. The pre-defined grid pattern is arranged in accordance with a random binary sequence where a zero of the binary sequence is represented by a first absorptive region of the plurality of first absorptive regions and a one is represented by a first reflective region of the plurality of first reflective regions, and the second substrate is disposed on the second face of the membrane 180 degrees out of phase relative to the first substrate.

15 Claims, 5 Drawing Sheets

U.S. PATENT DOCUMENTS 5,560,967 A 10/1996 Isaksen
5,700,527 A 12/1997 Fuchs et al.
5,817,992 A * 10/1998 D'Antonio ..... 181/295
5,962,107 A 10/1999 Lowery et al.
6,112,852 A * 9/2000 D'Antonio et al. ..... 181/295
6,617,002 B2 9/2003 Wood

* cited by examiner

| | | | | | | | | | | | | | | | | | | | | | | |
|---|---|---|---|---|---|---|---|---|---|---|---|---|---|---|---|---|---|---|---|---|---|---|
| 1 | 1 | 0 | 0 | 1 | 0 | 0 | 1 | 0 | 0 | 0 | 1 | 1 | 1 | 0 | 0 | 0 | 1 | 0 | 0 | 1 | 0 | 0 |
| 1 | 1 | 0 | 0 | 1 | 0 | 0 | 1 | 0 | 0 | 0 | 1 | 1 | 1 | 0 | 0 | 0 | 1 | 0 | 0 | 1 | 0 | 0 |
| 1 | 1 | 1 | 0 | 0 | 0 | 1 | 0 | 1 | 1 | 0 | 1 | 0 | 1 | 0 | 1 | 1 | 0 | 1 | 0 | 0 | 0 | 1 |
| 0 | 0 | 1 | 1 | 1 | 0 | 1 | 0 | 0 | 1 | 0 | 0 | 1 | 0 | 0 | 1 | 0 | 0 | 1 | 0 | 1 | 1 | 1 |
| 0 | 0 | 0 | 0 | 0 | 0 | 1 | 0 | 0 | 1 | 1 | 0 | 0 | 0 | 1 | 1 | 0 | 0 | 1 | 0 | 0 | 0 | 0 |
| 1 | 1 | 0 | 1 | 1 | 1 | 0 | 1 | 0 | 1 | 1 | 0 | 0 | 0 | 1 | 1 | 0 | 1 | 0 | 1 | 1 | 1 | 0 |
| 0 | 0 | 1 | 0 | 1 | 1 | 0 | 0 | 0 | 1 | 0 | 1 | 0 | 1 | 0 | 1 | 0 | 0 | 0 | 1 | 1 | 0 | 1 |
| 1 | 1 | 0 | 1 | 1 | 0 | 1 | 0 | 1 | 1 | 1 | 1 | 1 | 1 | 1 | 1 | 1 | 0 | 1 | 0 | 1 | 1 | 0 |
| 1 | 1 | 1 | 0 | 0 | 1 | 0 | 1 | 0 | 1 | 0 | 0 | 1 | 0 | 0 | 1 | 0 | 1 | 0 | 1 | 0 | 0 | 1 |
| 1 | 1 | 1 | 1 | 0 | 0 | 1 | 1 | 0 | 1 | 0 | 1 | 0 | 1 | 0 | 1 | 0 | 1 | 1 | 0 | 0 | 1 | 1 |
| 1 | 1 | 1 | 0 | 0 | 0 | 0 | 0 | 1 | 0 | 1 | 1 | 0 | 1 | 1 | 0 | 1 | 0 | 0 | 0 | 0 | 0 | 1 |
| 1 | 1 | 1 | 0 | 0 | 1 | 1 | 1 | 0 | 0 | 1 | 0 | 1 | 0 | 1 | 0 | 0 | 1 | 1 | 1 | 0 | 0 | 1 |
| 0 | 0 | 1 | 0 | 1 | 1 | 1 | 0 | 0 | 0 | 1 | 1 | 0 | 1 | 1 | 0 | 0 | 0 | 1 | 1 | 1 | 0 | 1 |
| 1 | 1 | 1 | 0 | 0 | 1 | 1 | 1 | 0 | 0 | 1 | 0 | 1 | 0 | 1 | 0 | 0 | 1 | 1 | 1 | 0 | 0 | 1 |
| 1 | 1 | 1 | 0 | 0 | 0 | 0 | 0 | 1 | 0 | 1 | 1 | 0 | 1 | 1 | 0 | 1 | 0 | 0 | 0 | 0 | 0 | 1 |
| 1 | 1 | 1 | 1 | 0 | 0 | 1 | 1 | 0 | 1 | 0 | 1 | 0 | 1 | 0 | 1 | 0 | 1 | 1 | 0 | 0 | 1 | 1 |
| 1 | 1 | 1 | 0 | 0 | 1 | 0 | 1 | 0 | 1 | 0 | 0 | 1 | 0 | 0 | 1 | 0 | 1 | 0 | 1 | 0 | 0 | 1 |
| 1 | 1 | 0 | 1 | 1 | 0 | 1 | 0 | 1 | 1 | 1 | 1 | 1 | 1 | 1 | 1 | 0 | 1 | 0 | 1 | 1 | 0 | |
| 0 | 0 | 1 | 0 | 1 | 1 | 0 | 0 | 0 | 1 | 0 | 1 | 0 | 1 | 0 | 1 | 0 | 0 | 0 | 1 | 1 | 0 | 1 |
| 1 | 1 | 0 | 1 | 1 | 1 | 0 | 1 | 0 | 1 | 1 | 0 | 0 | 0 | 1 | 1 | 0 | 1 | 0 | 1 | 1 | 1 | 0 |
| 0 | 0 | 0 | 0 | 0 | 0 | 1 | 0 | 0 | 1 | 1 | 0 | 0 | 0 | 1 | 1 | 0 | 0 | 1 | 0 | 0 | 0 | 0 |
| 0 | 0 | 1 | 1 | 1 | 0 | 1 | 0 | 0 | 1 | 0 | 0 | 1 | 0 | 0 | 1 | 0 | 0 | 1 | 0 | 1 | 1 | 1 |
| 1 | 1 | 1 | 0 | 0 | 0 | 1 | 0 | 1 | 1 | 0 | 1 | 0 | 1 | 0 | 1 | 1 | 0 | 1 | 0 | 0 | 0 | 1 |

102

○ OPEN/OPEN

⊗ OPEN/CLOSED

× CLOSED/OPEN

| CLOSED

FLAT PANEL DIFFUSER

BACKGROUND OF THE INVENTION

1. Field of the Invention

The field of the invention is paneling for diffusive and absorptive sound control.

2. Description of the Related Art

Sound is generated from a source producing audible waves transmitted outward from the source. A listener in a room with the source receives sound waves directly from the source or indirectly from sound waves being reflected from objects in the room or from the boundaries defining the room. The quality of sound may be altered, and may even be enhanced, by placing physical objects in the path of propagating sound waves. By absorbing, reflecting or diffusing sound waves, the quality of the sound can be enhanced. Absorption of sound waves occurs when a sound wave strikes a barrier that is capable of absorbing the energy of the sound wave. For example, absorption of energy of a sound wave is accomplished by placing in the path of the sound wave energy absorbing materials. For instance, insulation materials of various thicknesses, carpet, acoustic ceiling tile, draperies and other heavy fabrics will absorb energy from sound waves that strike these objects. By this absorption the sound wave will gradually lose energy. If a room is capable of totally absorbing sound then the room is described by the art as being dead. Ideally, a certain degree of energy or sound absorption is acceptable in a listening room to prevent formation of standing waves and/or undesirable reinforcement or cancellation of sound. However, the listening room should not be so sound-absorptive that the room becomes dead, or that certain frequencies are lost due to absorption.

Reflection of sound waves occurs by changing the direction of a propagating energy wave without absorption. A hard surface, such as a drywall surface, wood, plaster or cement walls can function as devices for accomplishing reflection. The more dense the flat surfaces are the greater the ability of the surface to reflect sound. A certain amount of sound reflection is also considered desirable for listeners.

Diffusion, which is somewhat more complex than reflection or refraction, is a combination of reflection and refraction of the sound wave at the same time. That is, different segments or different frequencies emanating from a sound source when diffused will be delayed in time due to scattering or reflection of the wave. A sound source generally emits more than a single sound frequency. In diffusion, the different frequencies are reflected and scattered so that different frequencies are delayed in time. By provision of diffusion in a small recording studio, sounds in the studio can be perceived by the listener as being like those associated with a larger room, because the listener is exposed to the reflected, scattered and time delayed sound waves. Diffuser panels, used in the art, generally provide a means for achieving at least one dimensional sound diffusion, i.e., reflection and refraction in one direction.

U.S. Pat. No. 5,160,816 describes a two dimensional sound diffuser having projecting elements having heights of between 1½ inches and 9 inches. Hence, the panels are not flat and their maximum depth renders them less attractive for home theatres and the like.

SUMMARY OF THE INVENTION

Consequently, it is the object of the present invention to provide a flat panel diffuser having a depth less than 4 inches.

That object amongst others is obtained by providing a flat panel diffuser including a membrane having first and second faces; a first substrate disposed on the first face of the membrane and having (i) a plurality of first absorptive regions and (ii) a plurality of first reflective regions formed as wells in a face of the first substrate, the first absorptive regions and the first reflective regions arranged in a pre-defined grid pattern; a second substrate disposed on the second face of the membrane and having (i) a plurality of second absorptive regions and (ii) a plurality of second reflective regions formed as second wells in a face of the second substrate, the second absorptive regions and the second reflective regions arranged in the pre-defined grid pattern. The pre-defined grid pattern is arranged in accordance with a random binary sequence where a zero of the binary sequence is represented by a first absorptive region of the plurality of first absorptive regions and a one is represented by a first reflective region of the plurality of first reflective regions, and the second substrate is disposed on the second face of the membrane 180 degrees out of phase relative to the first substrate.

The method of manufacturing the flat panel diffuser of the present invention includes the steps of providing first and second substrates and a membrane; generating a random binary sequence; punching a plurality of wells into both the first and second substrates in a grid pattern in accordance with the random sequence where a zero of the random sequence corresponds to a well, the first substrate having wells punched therein in accordance with the same random sequence; attaching the first substrate to a first face of the membrane; and attaching the second substrate to a second face of the membrane such that the second substrate is disposed on the second face of the membrane 180 degrees out of phase relative to the orientation of the first substrate on the first face of the membrane.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figures 1, 2:
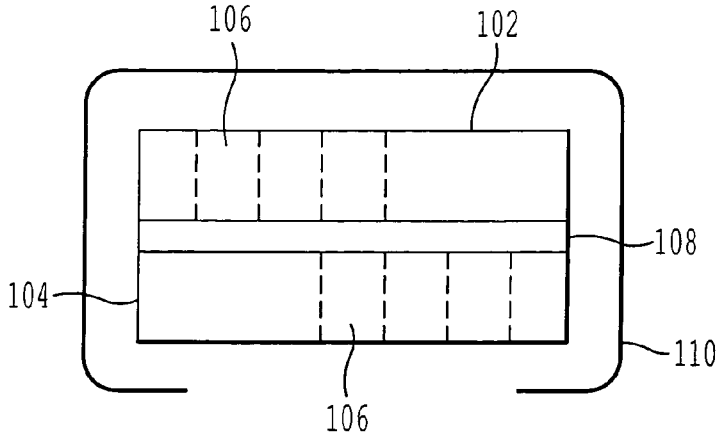
FIG. 1 is a perspective view of a flat panel diffuser according to one embodiment of the invention.
FIG. 2 is a top view of a substrate according to an embodiment of the invention showing a randomly generated pattern of absorptive portions and reflective portions.

Referring now to the drawings, wherein like reference numerals designate identical or corresponding parts throughout the several views. FIG. 1 illustrates a flat panel for diffusive and absorptive sound control according to an embodiment of the invention. The flat panel device includes a first substrate 102 and a second substrate 104. The first and second substrates are disposed on opposite faces of a membrane 108, respectively. The first substrate 102, the second substrate 104, and the membrane 108 are enclosed by a fabric 110 and are typically rectilinear in shape.

The first substrate 102 is designed to have a plurality of reflective regions 106 and a plurality of absorptive regions. FIG. 1 illustrates by way of example a first substrate 102 having two reflective regions 106 designed to allow audio waves to pass to the membrane 108. The remaining portions of the first substrate 102 function as absorptive regions designed to absorb audio waves. The reflective regions 106 are formed by creating wells through the depth of the substrate. According to an embodiment of the invention, the first substrate 102 is made of compressed fiberglass which functions to absorb the sound waves. However, the first substrate 102 can also be made of mineral wool or any porous absorbing material. The dimensions of the first substrate 102 generally are 2×4, 2×6, or any set desired at time of manufacture.

The second substrate 104 is disposed on the opposite face of the membrane 108. The second substrate 104 is also designed to have a plurality of reflective regions 106 and absorptive regions. According to an embodiment of the invention, the second substrate 104 is disposed on the membrane 180 degrees out of phase relative to the first substrate 102. That is, the second substrate 104 is designed to have the identical arrangement of absorptive and reflective regions as the first substrate 102. The second membrane also has the same dimensions as the first membrane. However, the second substrate 104 is rotated 180 degrees (or flipped over) relative to the first substrate 102 when disposed on the membrane 108.

The membrane 108 is solid and is designed to reflect the waves that travel thereto through the first substrate 102. That is, the membrane 108 does not have any wells formed therein. According to an embodiment of the invention, the membrane 108 is made of a light plastic. However, the membrane 108 can also be made of any light non-porous material. The dimensions of the membrane 108 generally are the same size as the substrates 102 and 104. According to one embodiment, the first and second substrates are no greater than two inches thick, respectively. Further, according to an embodiment, the membrane is no greater than 1.7 ounces per square feet.

Finally, a cover 110 made of fabric envelopes the membrane 108 sandwiched by the first substrate 102 and the second substrate 104. According to an embodiment of the invention, the cover is made of woven polyester. However, the cover 102 can also be made of any acoustically transparent material.

FIG. 2 illustrates the substrate 102 with a plurality of reflective regions represented by "1"s and absorptive regions represented by "0"s. The "1"s represent the reflective regions and the "0"s represent the absorptive regions in the abstract. The selected representation is not intended to limit the scope of the invention as the reflective regions can just as readily be represented by "0"s and the absorptive regions represented by "1"s. The pattern of reflective regions and absorptive regions is determined using a Gaussian random number generator. A "check sum" is used to verify that an equal distribution of absorptive and reflective regions are provided by the substrate both vertically and horizontally. The substrate 104 is designed to have the identical pattern of reflective regions and absorptive regions as in 102 based on the output of the Gaussian Theory of random number generation.

Figure 3:
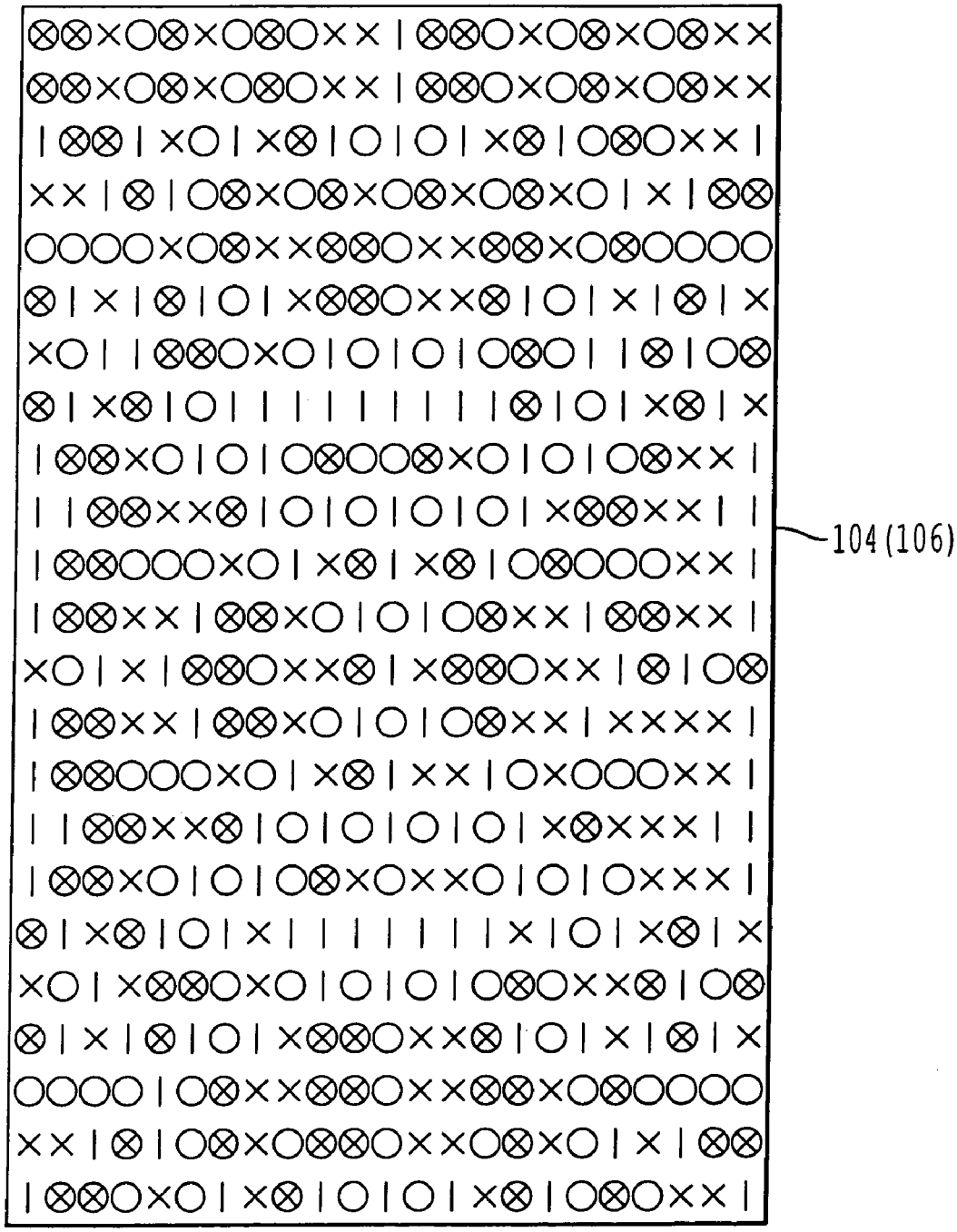
FIG. 3 illustrates the results of having first and second substrates 180 degrees out of phase.

FIG. 3 illustrates the result of "flipping" the second substrate 104 relative to the first substrate as disposed on the membrane 108. The empty circles represent that both the first and second substrates have no absorptive regions in that area of the panel. The circles with "X" placed therein represent that the first substrate has a well (a reflective region) and the second substrate has an absorptive region (no well) in that area of the panel. An "X" without a circle placed there around represents that the first substrate has an absorptive region (no well) and the second substrate has a reflective region (a well) in that area of the panel. Finally, a "1" represents that both the first and second substrates have absorptive regions (no wells) in that area of the panel.

The regions of the substrate represent by "1" will have the following effect on a sound wave directed to the substrate perpendicular to the substrate. First, there will be absorption due to the first substrate 102. Subsequently, there will be reflection due to the membrane 108 at a frequency that is determined by the mass and stiffness of the membrane. A wave having a frequency below that frequency will pass through the membrane 108 and be further absorbed by the second substrate 104 and finally as the remaining wave is reflected from the rear backing surface of the panel or the more dense wall or surface that the panel is mounted on, the process starts in reverse by passing back through the absorptive region of the first substrates 102 and 104. There will also be additional cancellation at certain frequencies due to wave interference from phase shifting due to the time delay of passing through the various combinations of substrate and membrane and reflecting back through the panel.

The regions of the substrate represented by "X" will have the following effect on a sound wave directed to the substrate perpendicular to the substrate. First, there will be absorption due to the first substrate 102. Subsequently, there will be reflection at frequency "Y" due to the membrane 108 and below frequency "Y" absorption as the wave passes through the well and is then reflected from the mounting surface back through the absorptive region of the first substrate 102. There will be cancellation at certain frequencies due to wave canceling from phase shifting due to the time delay of passing through the first substrate 102 and the membrane 108, plus the normal losses of the wave just passing through the first substrate 102 and the membrane 108. Below some frequency determined by the mass of the membrane 108, the wave will pass through the membrane 108 and will become attenuated due to the different density level of the membrane 108 relative to the first substrate 102 and then will of course pass through the well of the second substrate 104.

The regions of the substrate represented by "O" will have the following effect on a sound wave directed to the substrate perpendicular to the substrate. First, the sound wave will pass though the well of the first substrate 102. Subsequently, there will be reflection due to the membrane 108. Below some frequency determined by the mass of the membrane 108, the wave will pass through the membrane 108 and then will of course pass through the well of the second substrate 104 and reflect back from the mounting surface.

The regions of the substrate represented by "O" with an "X" superposed thereon will have the following effect on a sound wave directed to the substrate 102 perpendicular to the substrate. First, the sound wave will pass though the well of the first substrate 102. Subsequently, there will be reflection due to the membrane 108. Below some frequency determined by the mass of the membrane 108, the wave will pass through the membrane 108 and then be further absorbed by the substrate 104 and then will reflect off the mounting surface and start back through the panel with the same results.

The above scenarios are based upon a sound wave entering the substrate perpendicular to the surface of the substrate. However, when the angle of incidence moves away from the perpendicular, the reaction of the panel becomes more complex. At any particular angle, the sound wave can be passing in sequence through any or all of the areas of substrate as described.

Figure 4A:
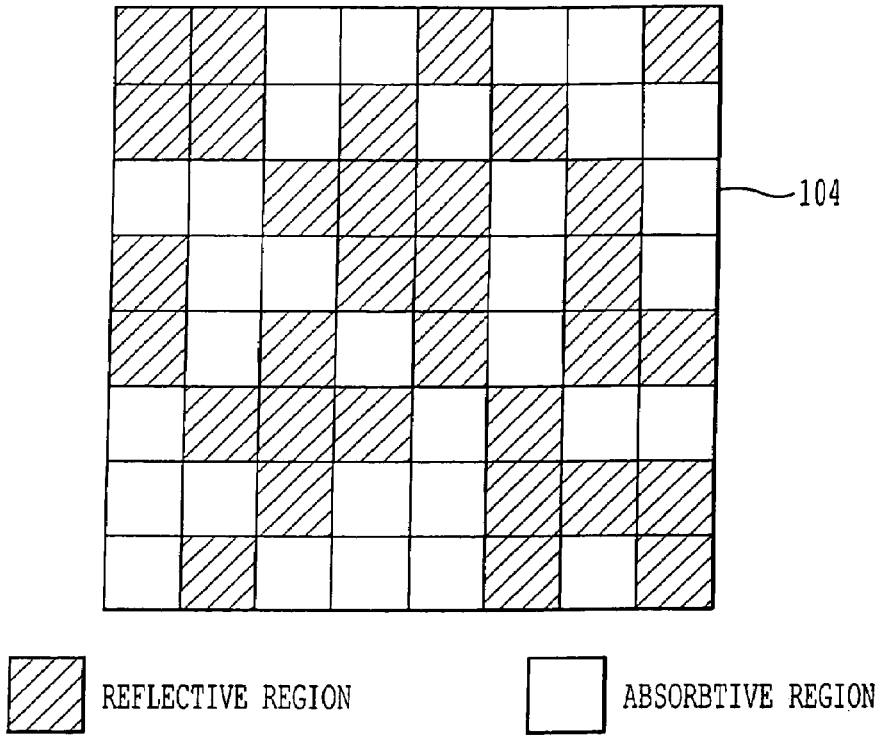
FIG. 4*a* illustrates a substrate according to an embodiment of the invention where the wells are punched out as squares.
Figure 4B:
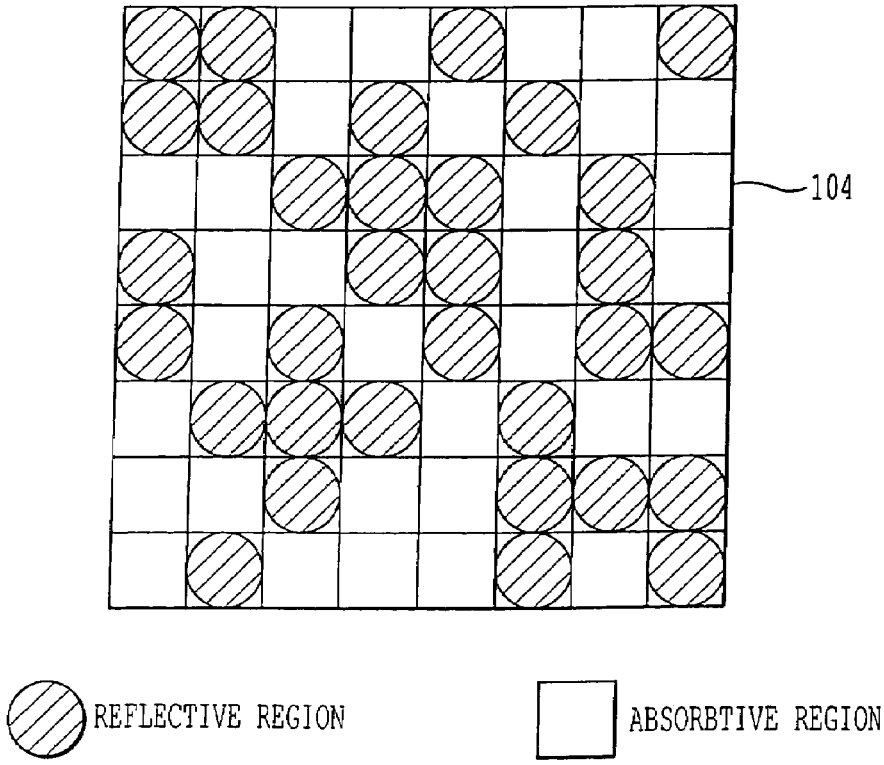
FIG. 4*b* illustrates a substrate according to an embodiment of the invention where the wells are punched out as circles.
Figure 4C:
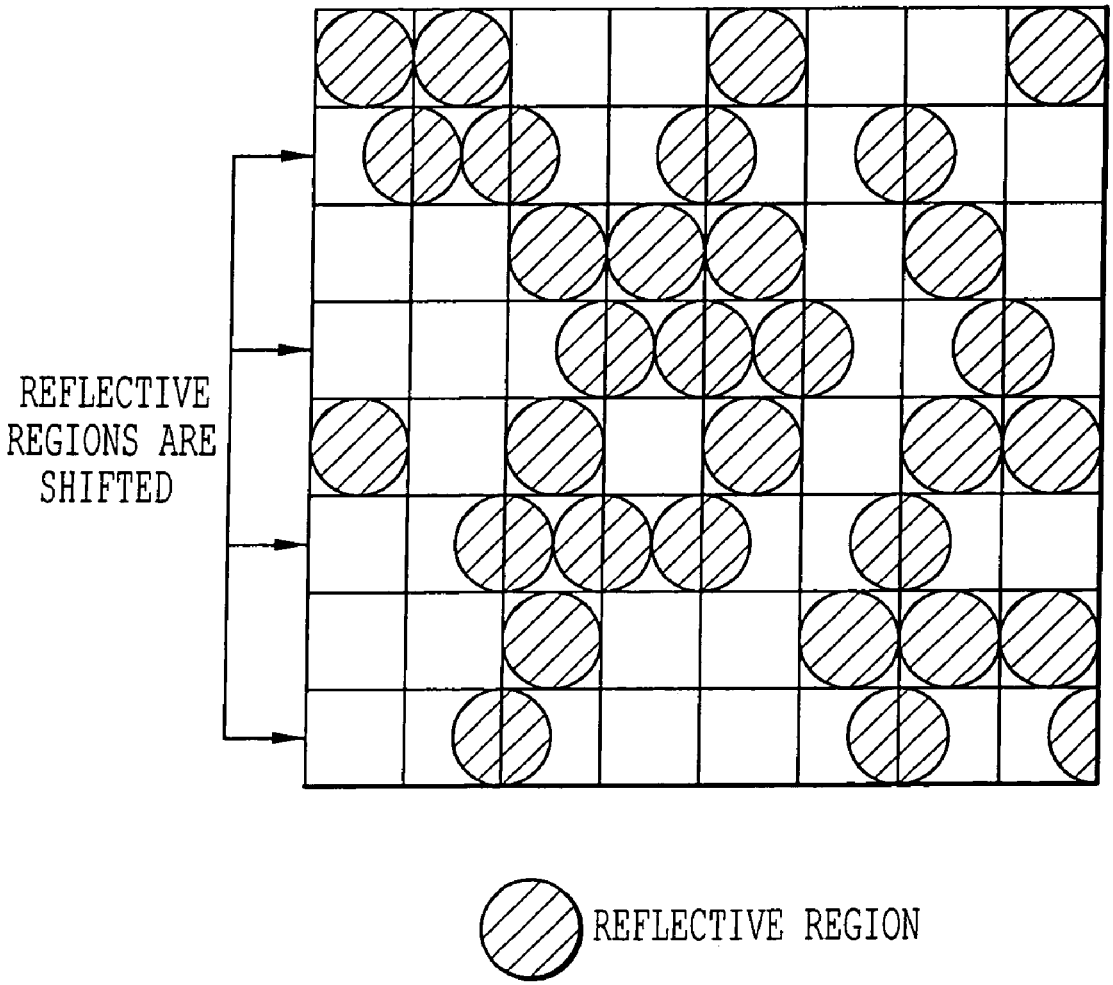
FIG. 4*c* illustrates a substrate according to an embodiment of the invention where the wells are punched out as circles and the rows of the matrix are offset by a radius of the punched circles.

FIG. 4*a* illustrates an embodiment of the invention where squares are punched out to create a well. However, if squares are punched out, a web must be created to hold the substrate together. The web takes up needed space from the matrix. FIG. 4*b* illustrates a preferred embodiment of the invention where circles are punched. The space surrounding the web is then used to support the matrix. Further, according to an embodiment of the invention, the rows of the matrix can be offset by a radius of the punched circles as illustrated in FIG. 4*c* to create a greater density. If this is done to one substrate, then it must be done to the second substrate.

Figure 5:
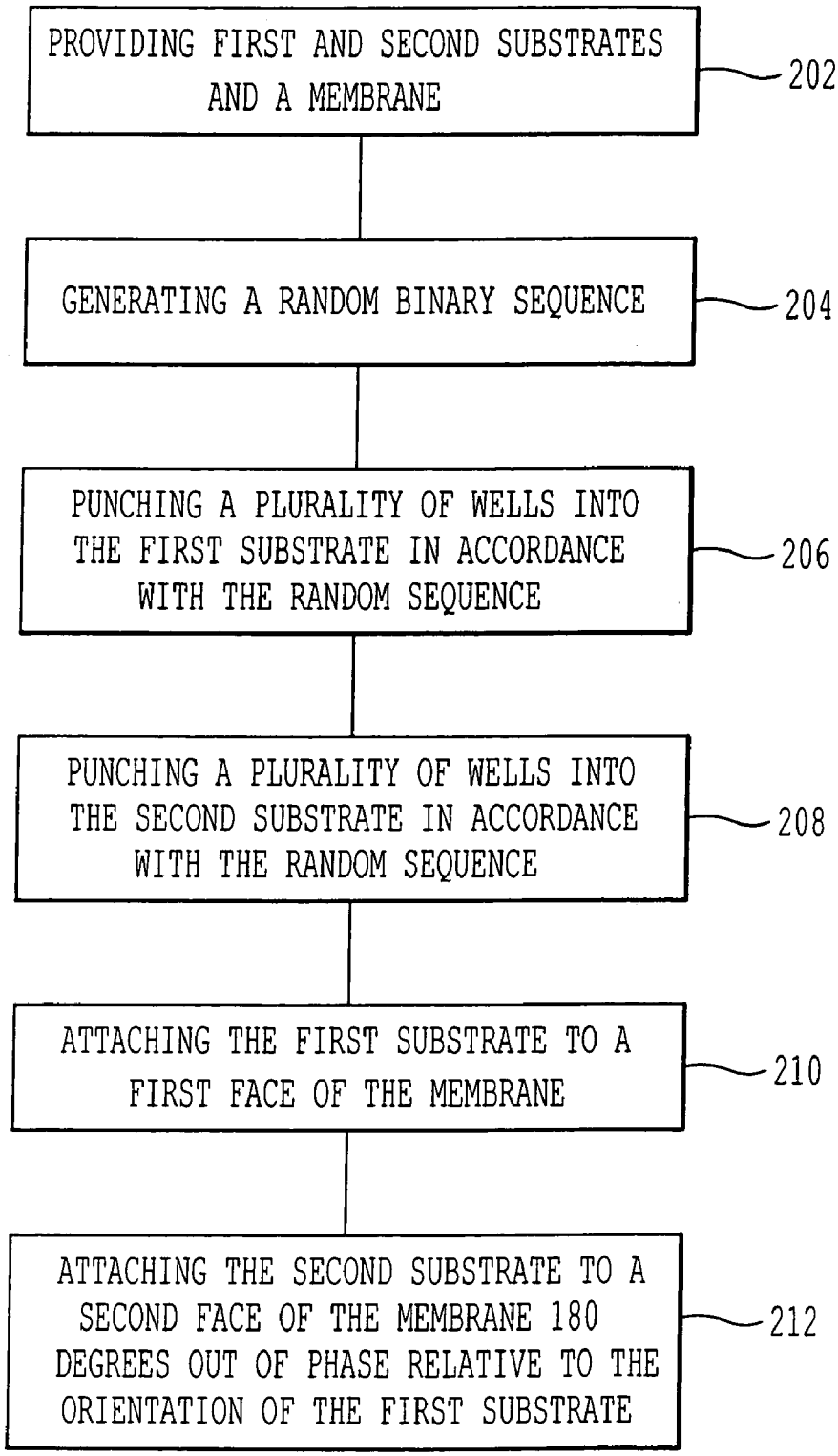
FIG. 5 is a flowchart showing the manufacturing steps of a flat panel diffuser according to an embodiment of the invention.

FIG. 5 illustrates the steps of manufacturing a flat panel device according to an embodiment of the invention. In step 202, a first and a second substrate and a membrane are provided. In step 204, a random number binary sequence is generated. In a preferred embodiment, the random number generator is Gaussian. However, other random number generators can be used so long as the distribution of "wells" and "absorbers" is confirmed as being equal both horizontally and vertically. In step 206, a plurality of wells are punched into the first substrate in accordance with the generated random sequence. In step 208, a plurality of wells are punched into the second substrate in accordance with the generated random sequence. In step 210, the first substrate is attached to a first face of the membrane. Finally, in step 212, the second substrate is attached to the second face of the membrane 180 degrees out of phase relative to the orientation of the first substrate.

Obviously, numerous modifications and variations of the present invention are possible in light of the above teachings. For example, in lieu of creating wells in the first and second substrates, wells could be punched out of the first substrate and the membrane (180 degrees out of phase). The second substrate would be un-punched. It is therefore to be understood that within the scope of the appended claims, the invention may be practiced otherwise than as specifically described herein.

The invention claimed is:

1. A device comprising:

a membrane having first and second opposing faces;

a first substrate disposed on the first face of the membrane and having (i) a plurality of first absorptive regions and (ii) a plurality of first reflective regions formed as wells in a face of the first substrate, the first absorptive regions and the first reflective regions arranged in a pre-defined grid pattern; and a second substrate disposed on the second face of the membrane and having (i) a plurality of second absorptive regions and (ii) a plurality of second reflective regions formed as second wells in a face of the second substrate, the second absorptive regions and the second reflective regions arranged in the pre-defined grid pattern;

wherein the pre-defined grid pattern is arranged in accordance with a random binary sequence where a zero of the binary sequence is represented by a first absorptive region of the plurality of first absorptive regions and a one is represented by a first reflective region of the plurality of first reflective regions, and the second substrate is disposed on the second face of the membrane 180 degrees out of phase relative to the first substrate.

2. The device of claim 1, wherein the random binary sequence is generated by a Gaussian random number generator.

3. The device of claim 1, wherein the membrane, the first substrate, and the second substrate are rectilinear in shape.

4. The device of claim 1, wherein there is an equal distribution of first absorptive regions and first reflective regions in both the vertical and horizontal directions, respectively, of the first substrate and there is an equal distribution of second absorptive regions and second reflective regions in both the vertical and horizontal directions, respectively, of the second substrate.

5. The device of claim 1, wherein the first and second substrates are made of compressed fiberglass.

6. The device of claim 1, wherein the membrane is made of a solid material.

7. The device of claim 1, wherein each of the first and second substrates are no greater than two inches thick.

8. The device of claim 1, wherein the membrane is no greater than 1.7 ounces per square ft.

9. The device of claim 1, wherein the membrane is made of a non-porous material.

10. The device of claim 1, wherein the first and second substrates and the membrane are at least partially covered by a fabric.

11. The device of claim 1, wherein the wells are cylindrical in shape.

12. A method of manufacturing a device, comprising the steps of:

providing first and second substrates and a membrane;

generating a random binary sequence;

punching a plurality of wells into both the first and second substrates in a grid pattern in accordance with the random sequence where a zero of the random sequence corresponds to a well, the first substrate having wells punched therein in accordance with the same random sequence;

attaching the first substrate to a first face of the membrane; and attaching the second substrate to a second face of the membrane such that the second substrate is disposed on the second face of the membrane 180 degrees out of phase relative to the orientation of the first substrate on the first face of the membrane.

13. The method of manufacturing of claim 12, wherein the generating step includes the step of using a Gaussian random number generator to generate the random well sequence.

14. The method of manufacturing of claim 12, further comprising the step of:

generating a check sum to confirm that an equal number of ones and zeros are generated in the binary number sequence in both the vertical and horizontal directions of the grid pattern.

15. The method of manufacturing of claim 12, further comprising the step of:

covering at least a part of the first and second substrates and the membrane with a fabric.

* * * * *